United States Patent [19]

King

[11] 3,972,800

[45] Aug. 3, 1976

[54] FLUID TREATER HAVING INTENSIFIED ELECTRIC FIELD

[76] Inventor: Arthur S. King, 8021 Cherokee Lane, Leawood, Kans. 66206

[22] Filed: Apr. 3, 1975

[21] Appl. No.: 564,793

Related U.S. Application Data

[63] Continuation-in-part of Ser. No. 421,336, Dec. 3, 1973, abandoned.

[52] U.S. Cl. ..... 204/302; 204/149

[51] Int. Cl.² ..... B03C 5/02

[58] Field of Search ..... 204/149, 302, 184–186

[56] References Cited

UNITED STATES PATENTS

| | | | |
|---|---|---|---|
| 2,665,246 | 1/1954 | Bates | 204/184 |
| 3,415,735 | 12/1968 | Brown et al. | 204/302 |
| 3,585,122 | 6/1971 | King | 204/302 |
| 3,766,050 | 10/1973 | Pados | 204/302 |
| 3,843,507 | 10/1974 | Kwan | 204/149 |
| 3,852,178 | 12/1974 | Griswold | 204/186 |
| 3,891,528 | 6/1975 | Griswold | 204/186 |

OTHER PUBLICATIONS

"Gypping the Gullible," by R. M. Burns, J. Electrochem. Soc., vol. 100, No. 8, Aug. 1953, p. 209c.

"So Called Electrical & Catalytic Treatment of Water for Boilers," R. Eliassen et al., J. Am. Water Works Assn., vol. 44, pp. 576ff (1952).

"ISCC Urges Caution in Use of Unscientific Devices Intended to Prevent Corrosion," J. Electrochem. Soc., p. 233c, Aug. 1953.

"Electrical Treatment of Boiler Feed Waters," Hurley, et al., Journal of Inst. of Water Engineers, pp. 686–699 (1951).

R. Eliassen et al., "Experimental Evaluation of 'water Conditioner' Performance," J. Am. Water Works Assn., pp. 1179–1190, Sept. 1957.

James, "Water Treatment," (1965), pp. 166–167.

E. Nordell, "Water Treatment for Industrial and Other Uses," Second Edition, Reinhold, N.Y. (1961), pp. 270–271.

*Primary Examiner*—John H. Mack
*Assistant Examiner*—Aaron Weisstuch
*Attorney, Agent, or Firm*—Schmidt, Johnson, Hovey & Williams

[57] ABSTRACT

A fluid treater relies upon the presence of an electric field in a treating region, without electrical current flow, to cause solids suspended in the fluid to precipitate therefrom after the fluid has passed through the treater. The treater has concentrically disposed electrodes, the inner of which is negatively charged and is bare, having direct, physical contact with the fluid flowing in the region between the electrodes so that the electric field produced in such region is greatly intensified, thereby accelerating and promoting the action of the field upon the fluid. The housing of the treater is constructed from a suitable polyvinylchloride resin and serves as a dielectric between the electrodes to prevent electrical current flow through the treating region. The dielectric housing enables the treater to withstand high power applications, thereby further promoting precipitation.

10 Claims, 4 Drawing Figures

FLUID TREATER HAVING INTENSIFIED ELECTRIC FIELD

CROSS-REFERENCE

This is a continuation-in-part of my prior copending application by the same title, Ser. No. 421,336 filed Dec. 3, 1973, abandoned.

This invention relates to the treating of fluids, such as water having suspended solids therein, by non-chemical means through electricity. In its most basic respects, the invention differs from conventional electrolytic treaters in that they rely upon a definite electrical current flow between two oppositely charged electrodes, while the treater of the present invention operates in the nature of a capacitor without electrical current flow between its two oppositely charged electrodes, relying solely upon the presence of an electric field between the two electrodes to treat the fluid.

The primary object of the present invention is to improve upon the teachings of my prior U.S. Pat. No. 3,585,122 issued June 15, 1971 and showing a number of different treaters employing electric fields without electrical current flow through the treating regions thereof. The treaters of said patent, while being described primarily in terms of usage with "hard" water, have also been successfully employed in installations where assorted suspended solids must be removed from water such as, for example, the drain water from truck wash installations. Before returning such dirty water to the river, the water must first have a certain amount of its suspended materials removed.

One treater disclosed in the aforesaid patent utilizes a cylindrical, metallic housing as the outer electrode and a hollow, cigar-shaped, Teflon jacketed, metallic member as the inner electrode coaxially disposed within the housing. This arrangement has proven to be highly successful and extremely satisfactory in a multitude of situations wherein a clean, unscaled piping system or the like is involved and it is necessary only for the treater to maintain the system in its initially clean condition. Moreover, this treater has performed admirably where existing scale need not be removed at high rate of speed but can be carried out over a prolonged period of time. Similarly, this treater has been found effective in removing many suspended solids from dirty water.

However, because of its particular construction, this treater is somewhat limited in the amount of electrical power it can withstand and still operate properly, and this can be somewhat of a detriment because it has been found that the amount of electrical potential across oppositely charged electrodes has a definite bearing upon the speed at which scale-encrusted surfaces become descaled and suspended solids precipitate from their suspension. It was initially felt that by simply increasing the electrical potential across the electrodes of the subject treater of my earlier Patent, a direct gain in the rate of descaling or solids precipitation would be obtained. However, it was found that when subjected to electrical power of higher magnitudes, the Teflon skin about the inner electrode would tend to break down, allowing pinholes to develop which caused electrical current to flow between the inner and outer electrodes to the detriment of successful operation of the treater.

It has also been discovered that significantly improved results can be obtained when the fluid is flowed in direct physical contact with a properly configured "active" or negatively charged electrode. Such an arrangement significantly intensifies the effects of the electric field on the fluid, even without increasing the power supplied to the treater. When this discovery was applied to the subject treater of the aforesaid Patent, however, the result was only slight improvement in the treating action. This was due to the fact that its bare electrode was the outer, tubular electrode, and when such was negatively charged in accordance with the new discovery, the negative charges tended to gather on the outer surface of the tubular electrode instead of the inner surface thereof in accordance with the known phenomenon that electric charges will accumulate on the outer surface of a hollow globe or tube instead of on the interior surface thereof. Thus, the negative charges were not in direct physical contact with the flowing fluid.

Accordingly, one important object of the present invention is to provide an improved treater of special construction that successfully incorporates the discoveries above referred to relating to intensification of the electric field action by increased power and efficient utilization of the active electrode.

More specifically, an important object of the instant invention is to provide an improved treater wherein the inner electrode of a concentrically disposed pair of electrodes becomes the active or negatively charged, bare electrode that is exposed to direct physical contact with the flowing fluid.

A further specific object of the invention is to provide a treater as aforesaid having housing structure constructed from dielectric material, such as polyvinylchloride resin instead of from metal whereby, when the outer electrode is disposed around the outside of the housing, the latter serves to prevent electrical current flow between the electrodes, even under high voltage conditions. In the drawing.

Figure 3:
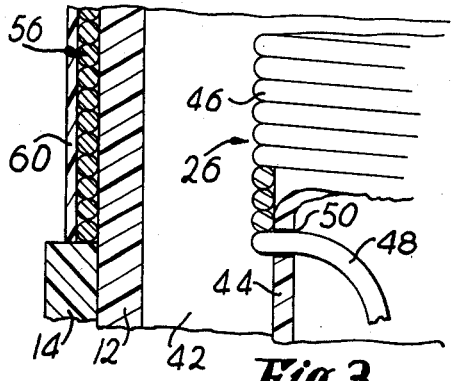
Figure 4:
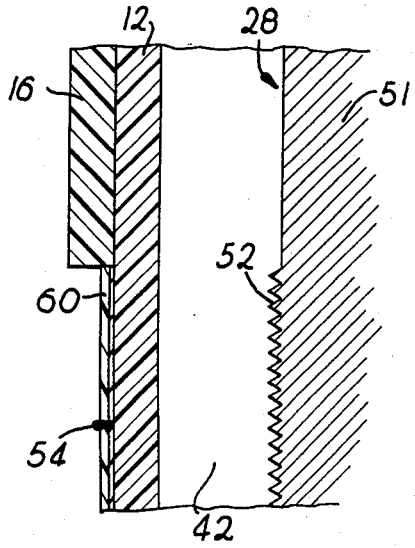

FIG. 3 is an enlarged, fragmentary, partly cross-sectional and partly elevational view of the treater illustrating the wire-wound construction of the inner electrode in conjunction with an alternate, wire-wound construction for the outer electrode; and FIG. 4 is an enlarged, fragmentary, vertical cross-sectional view of the treater illustrating details of the outer electrode but with an alternate, carbonaceous, solid inner electrode in lieu of the wire-wound electrode of the previous figures.

The treater of the present invention has an elongated, tubular housing 10 of dielectric material such as a suitable polyvinylchloride resin including a continuous, cylindrical wall 12 open at its opposite ends and a pair of end caps 14 and 16 that receive the opposite open ends of wall 12. The lower end of wall 12 is provided with an inlet opening 18 for the fluid to be treated, such inlet opening being supplied by an inlet conduit 20 approaching wall 12 substantially tangentially. Similarly, the opposite end of wall 12 has an outlet opening (not shown) that communicates with an outlet conduit 22 leading substantially tangentially away from wall 12. The end caps 14 and 16 extend over the inlet opening 18 and the outlet opening and thus also must be provided with suitable openings for the conduits 20 and 22, but such arrangement is not critical and the end caps 14 and 16 could be of such lengths as to terminate before the inlet opening 18 and the outlet opening are reached.

Figure 1:
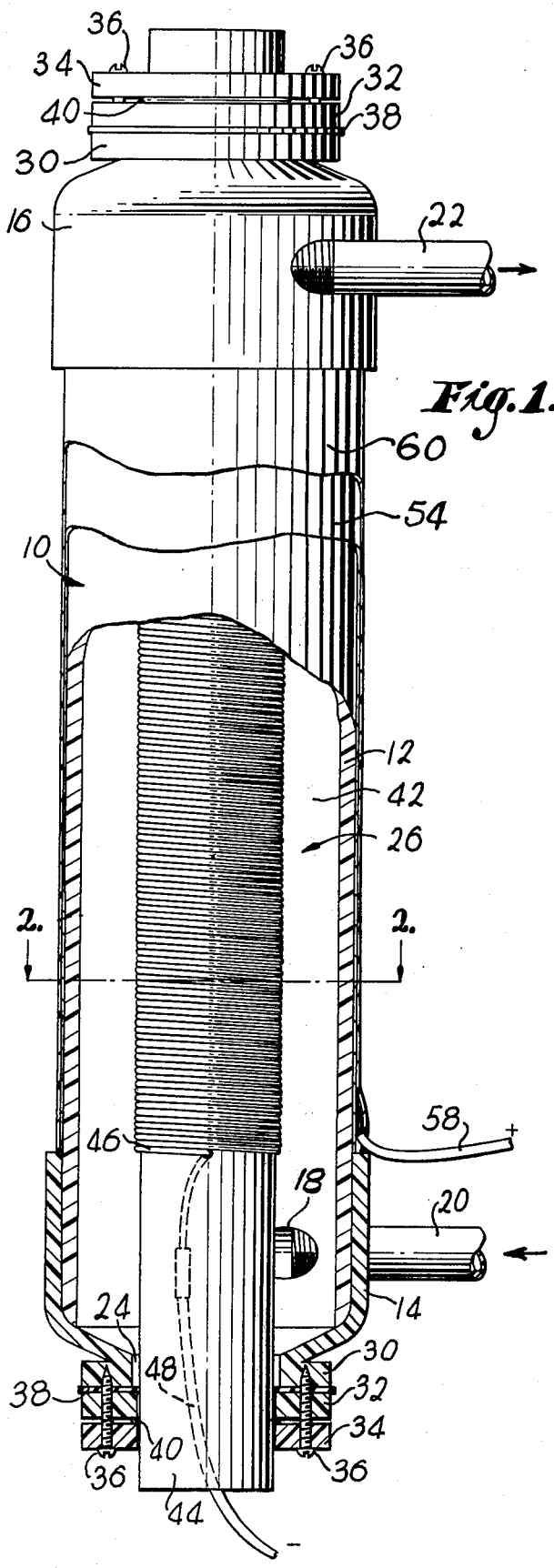
FIG. 1 is an elevational view of a treater embodying the principles of the present invention, the treater being partially broken away and shown in cross-section to reveal details of construction.
Figure 2:
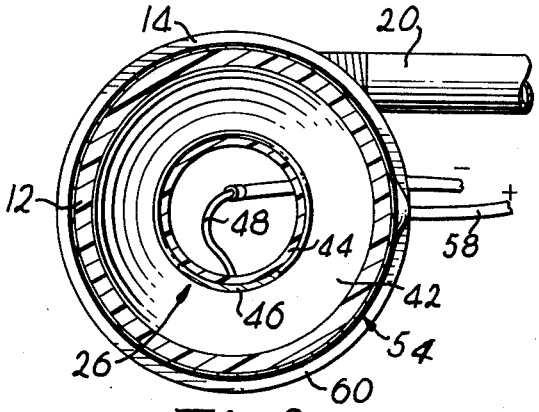
FIG. 2 is a horizontal cross-sectional view of the treater taken along line 2—2 of FIG. 1.

Each of the end caps 14 and 16 has an aperture 24 disposed centrally therein in coaxial relationship with wall 12 for receiving an inner electrode which may take the form of that designated by the numeral 26 in FIGS. 1, 2 and 3, or that designated by the numeral 28 in FIG. 4. The differences between the electrodes 26 and 28 will subsequently be made clear, but in either case, the mounting thereof within the housing 10 is precisely the same. Using the electrode 26 as an example, the electrode 26 extends through the apertures 24 in the opposite end caps 14 and 16 outwardly beyond housing 10 and through a series of three superimposed, annular discs 30, 32 and 34 of dielectric material. Each disc 30 is integral with or is securely bonded to the corresponding end cap 14 or 16, while the other discs 32 and 34 are secured to the disc 30 by virtue of screws 36. A flat gasket 38 is clamped between each pair of discs 30 and 32 by screws 36, and a resilient O-ring 40 circumscribing the electrode 26 between the discs 32 and 34 is tightly compressed against electrode 26 in sealing engagement therewith by the disc 34 which is drawn against disc 32 by screws 36.

The discs 30-34 maintain the electrode 26 in coaxial relationship with the housing 10, and because the latter is of greater diameter than the electrode 26, an annular treating region 42 is defined by the space between the inner electrode 26 and wall 12. Thus, when the fluid is introduced into the housing 10 by conduit 20, it is swirled upwardly around the electrode 26 through region 42 until leaving housing 10 through conduit 22.

That version of the inner electrode designated by the numeral 26 comprises an open ended tube 44 of dielectric material and a conductor 46 that is wound helically around tube 44 with its coils in side-by-side relationship to one another. One end of conductor 46 simply terminates on tube 44 adjacent the upper end of the latter, while the opposite terminal end 48 of conductor 46 is connected to the negative side of a power source. Such connection may be easily made by virtue of the fact that terminal end 48 may be threaded through a hole 50 in the wall of tube 44 (FIG. 3) and then extended through the interior of tube 44 exiting from the latter outside of the housing 10. The hole 50 must, of course, be suitably sealed to avoid leakage of fluid from the treater through the inside of tube 44.

In this manner, the inner electrode 26 is provided with a conductive surface that will be exposed to direct physical contact with the fluid moving through region 42. Moreover, the individual coils of conductor 46 present generally sharp, charge-concentrating surfaces all along the length of electrode 26 which helps assure that the electric field of the treater is located within the area exposed to the fluid and not distributed to other non-essential locations.

The other form of inner electrode (FIG. 4), designated by the numeral 28, differs from electrode 26 in that it is a solid carbonaceous rod 51 that extends through the end caps 14 and 16 in the same manner as electrode 26. The rod 51 has particular value in that when negatively charged by an outside power source, the carbonaceous material becomes highly activated, and thus tends to augment the treating action to a significant degree. If desired, the carbon rod 51 may be provided with a series of circular ribs 52 along the length thereof for charge-concentrating purposes such as afforded by the arcuate peripheries of the coils of the conductor 46 on electrode 26.

The outer electrode of the treater may take the form of a layer of metal foil 54 that is wrapped around wall 12 as illustrated in FIGS. 1, 2 and 4, or, it may take the form of conductor windings 56 about wall 12 as illustrated in FIG. 3. It is to be understood that the windings 56 are connected at one end to the positive side of a source of electrical power as is the sheet 54 by a lead 58. When the conductor windings 56 are utilized in conjunction with either form of the inner electrode, the windings 56 are maintained in registration with the coils of the conductor 46 or the ribs 52 of rod 51 in order to properly concentrate the electric field. An insulating covering 60 may be wrapped around the outer electrodes 54 or 56.

In use, the intensified treater of the present invention is beneficial not only in the treatment of hard water, but also in the treatment of suspensions to remove the solid particles therefrom in order to place the liquid in condition for discharge into rivers and streams. One suggested manner of using the treater for the removal of suspended solids is to couple the inlet conduit 20 thereof with a source of dirty water, force the dirty water through the treating region 42 and then out the treater through outlet conduit 22 into a settling basin or the like. In some instances, it may be necessary or desirable to design the plumbing of the installation such that the dirty water is recycled a number of times through the treater prior to being ultimately discharged into the settling basin.

When high voltage is applied, on the order of 20,000 to 50,000 volts, an intense electric field is established within region 42, and such intense field apparently causes the suspended solids to take on a store of energy, this in turn causing adjacent particles of the solids to combine and ultimately settle out when the treated water is directed into the settling basin. The action of the treater is not instantaneous, that is, the solid particles do not immediately drop from the suspension upon being subjected to the electric field, but rather the action is time-dependent. Thus, the settling basin into which the treated suspension is discharged provides ample opportunity for the solid particles to precipitate from the suspension before the water is then further treated or discharged.

Because the relatively thick polyvinylchloride wall 12 exists between outer electrode 54 or 56 and the inner electrode 26 or 28, there can be no current flow through region 42. Thus, a highly intense field can be created, in contrast to the treaters in my earlier patent having Teflon-jacketed inner electrodes, all of which significantly increases the speed and efficiency of the precipitation process. Further, regardless of the particular voltage level chosen, the electric field is intensified by virtue of the fact that the bare inner electrode 26 or 28 is the active or negatively charged electrode of the treater and is in direct physical contact with the fluid moving through region 42. In this respect, the negative charges of the inner electrode 26 or 28 become located all along the outer periphery thereof on the surfaces of the conductor coils 46 or the ribs 52, thereby placing such charges in ideal position to affect the properties of the fluid flowing therepast.

This arrangement is to be contrasted to one wherein a tube is negatively charged and the fluid is directed through the interior of the tube. In such a situation, as described early in the specification, the negative charges on the tube migrate to the outside surface thereof out of contact with the fluid instead of lying along the inside surface of the tube to contact the fluid in the desired manner. Hence, in the present treater, if the charges of the inner and outer electrodes 26 and 54, for example, were reversed and the dielectric applied to the inner electrode 26 instead of to the outer electrode 54, the desired increased intensity would not be obtained because the negative charges would simply gather on the outside surface of electrode 54 instead of the inside surface thereof.

In order to compare the effectiveness of the intensified treater of the present invention with that of my previous treaters such as disclosed in the earlier identified patent, one treater such as disclosed in FIG. 8 of that patent was operated alongside a second treater constructed as illustrated in FIG. 1 of the present drawing. In the first test the treater constructed according to FIG. 8 of my patent (hereinafter referred to as the old treater) was subjected to 3,400 volts (because a higher voltage would result in burning pinholes through the Teflon jacket covering the inner electrode), while the treater according to the present invention (hereinafter referred to as the "intensified" treater) was subjected to 50,000 volts. A test suspension was prepared by mixing tap water and finely powdered gypsum. The mixture was then allowed to stand until a stable suspension was achieved.

A quantity of the stable suspension was added to the old treater, a second quantity was added to the intensified treater and a third quantity was held in reserve as a control amount. The suspensions in the two treaters were allowed to stand in a static condition for 2.0 hours, while the units were operated under voltage conditions above recited. During the experiment, the turbidity of the control amount was measured four times with a Hellige Turbidimeter, the resulting reading being 35.4, 33.6, 37.6 and 35.1 turbidity units for an average value of 35.4.

After being allowed to stand in a static condition for two hours, the turbidity of the suspensions in the two treaters was measured, this indicating that the turbidity of the suspension in the old treater had dropped to 16.5 units and the turbidity of the suspension in the intensified treater had dropped to 12.7 units. This showed, then, that subjecting the static suspension to an electric field significantly decreased the turbidity as the particles precipitated out of the suspension. Moreover, it showed that subjecting the static suspension to 50,000 volts instead of 3,400 volts resulted in an even more marked decrease in the turbidity over the same period of time.

The effectiveness of the same two treaters was also examined experimentally where a suspension was continuously circulated through the treaters rather than remaining within the electric field in a static condition as under the previous experiment. In this second test the suspension consisted of drain water from a facility in which transport trucks were washed to remove dirt and grime from their exterior surfaces as well as to remove chemical residue from inside the storage tanks of the transport vehicles. This suspension, therefore, contained water, detergent, particles of clay, paint ingredients and some amounts of phenols.

Each treater was set up with its own recirculation system in which an amount of the agitated suspension was pumped through the treater at a rate of one gallon per minute for one hour, the suspension being continuously recirculated through the treater during this period. The old treater was operated at 3,400 volts, while the intensified treater was operated at 20,000 volts. After each treater had operated for one hour, it was turned off and the suspension was drained to a settling basin where it was allowed to stand without exposure to the electric field of its treater.

After sitting in the settling basin for eighteen hours, the turbidity of the suspension from the old treater was measured with a Hellige Turbidimeter and found to be 88 turbidity units. After the same elapsed time, the turbidity of the suspension from the intensified treater was measured with the same device and found to be 42 turbidity units. A control volume of the suspension not subjected to treatment by either of the treaters was found to have a turbidity of 150 units prior to agitation and passage of the other two quantities through their treaters. The same turbidimeter was employed to measure the turbidity of the solutions from the two treaters and the control amount. This, then, shows that circulating the suspension through either of the treaters and allowing it to stand for a substantial period results in a significant drop in the turbidity of the suspension and further indicates that the intensified treater was at least twice as effective as the old treater in reducing the turbidity of the suspension.

Samples of the circulated suspensions from the treaters and the control amount were also analyzed using a Hach dr/2 Spectrophotometer which produces results in the same order as obtained using the Hellige Turbidimeter. After the solutions from the treaters and the control volume were allowed to settle for twenty-five hours, a sample of the control volume was analyzed to contain 270 milligrams suspended solids per liter, while a sample from the suspension subjected to the old treater registered 100 milligrams suspended solids per liter. In contrast to these figures, a sample of the suspension from the intensified treater registered 22 milligrams suspended solids per liter.

After approximately 96 hours total settling time, samples of the suspensions from the control amount, old treater and intensified treater were again analyzed using the Spectrophotometer with the result that the control sample registered 240 milligrams suspended solids per liter, the old treater registered 105 milligrams suspended solids per liter and the intensified treater registered 24 milligrams suspended solids per liter.

It is clear from the foregoing tests that the treater of the present invention does have a significant effect on suspensions passed therethrough and allowed to settle for a substantial period of time. That effect has been even further enhanced in some commercial installations by coupling a "seeding" device into the system downstream from the treater of the present invention. In such circumstances seeds from a sacrificial electrode are introduced into the suspension already passed through the present treater, and such seeds form a nucleus about which the energized suspended solids may cluster, thereby promoting subsequent settling out or filtration.

Having thus described the invention what is claimed as new and desired to be secured by Letters Patent is:

1. A device usable for treating fluids to induce precipitation of suspended solid material comprising:

means defining an elongated, tubular housing having a fluid inlet and a fluid outlet at opposite ends thereof;

an elongated, bare inner electrode coaxially disposed within said housing in radially spaced relationship thereto to define an annular treating region between said housing and said electrode;

an outer electrode surrounding said region; and means electrically connecting said electrodes across a source of direct potential, said inner electrode being connected to the negative side of said source for negative charging of the inner electrode, and said outer electrode being connected to the positive side of said source for positive charging of the outer electrode, said housing-defining means including a continuous cylindrical wall of dielectric material disposed between said outer electrode and said region to prevent electrical current flow across the latter between said electrodes when the latter are charged.

2. A device as claimed in claim 1, wherein said outer electrode includes a layer of metal foil.

3. A device as claimed in claim 1, wherein said inner electrode includes a member constructed from electrically insulating material and a bare conductor wound helically around said member with the coils of the conductor disposed in side-by-side relationship with one another.

4. A device as claimed in claim 3, wherein said member comprises a tube communicating with the outside of said housing, said conductor being directed into the tube from outside the housing and emerging through the wall of the tube thence to form said coils inside the housing.

5. A device as claimed in claim 3, wherein said outer electrode includes a conductor wound helically about said housing in longitudinal registration with the coils of the inner electrode whereby to concentrate said field.

6. A device as claimed in claim 1, wherein said inner electrode comprises a solid, carbonaceous rod.

7. A device as claimed in claim 6, wherein the periphery of said rod has a longitudinally extending series of charge-concentrating ribs thereon.

8. A device as claimed in claim 7, wherein said outer electrode includes a conductor wound helically about said housing and in longitudinal registration with said series of ribs for further concentrating the field.

9. A device as claimed in claim 1, wherein said outer electrode is provided with a layer of electrically insulating material overlying the same.

10. A device as claimed in claim 1, wherein said wall is constructed from a polyvinylchloride resin.

* * * * *